US006353966B1

(12) United States Patent
King

(10) Patent No.: US 6,353,966 B1
(45) Date of Patent: Mar. 12, 2002

(54) FRAMELESS CABINET HINGE CONNECTOR SYSTEM

(76) Inventor: Ron E. King, 1545 River Park Dr. Suite 450, Sacramento, CA (US) 95815

( * ) Notice: Subject to any disclaimer, the term of this patent is extended or adjusted under 35 U.S.C. 154(b) by 0 days.

(21) Appl. No.: 09/662,518

(22) Filed: Sep. 14, 2000

Related U.S. Application Data

(63) Continuation-in-part of application No. 09/181,434, filed on Oct. 28, 1998, now Pat. No. 6,163,930.

(51) Int. Cl.[7] ..... E05D 5/00

(52) U.S. Cl. ..... 16/235; 16/237; 16/271; 16/382; 16/389

(58) Field of Search ..... 16/235, 237, 252, 16/253, 271, 382, 388, 389; 312/326, 329, 109; 411/187, 186, 185, 173, 176

(56) References Cited

U.S. PATENT DOCUMENTS

| | | | | |
|---|---|---|---|---|
| 4,094,352 A | * | 6/1978 | Hlinsky | 411/185 |
| 4,223,711 A | * | 9/1980 | Tabor | 411/185 |
| RE30,717 E | | 8/1981 | Dargene | |
| 4,517,706 A | | 5/1985 | Lautenschläger et al. | |
| 4,615,072 A | | 10/1986 | Lautenschläger, Jr. et al. | |
| 4,698,877 A | | 10/1987 | Lautenschläger, Jr. et al. | |
| 4,703,539 A | | 11/1987 | Lautenschläger, Jr. et al. | |
| 4,704,766 A | | 11/1987 | Almestad | |
| 4,799,290 A | | 1/1989 | Lautenschläger, Jr. et al. | |
| 4,856,141 A | | 8/1989 | Sassenberg | |
| 4,976,006 A | | 12/1990 | Lautenschläger | |
| 5,052,077 A | | 10/1991 | Lautenschläger, Jr. et al. | |
| 5,067,200 A | | 11/1991 | Stowell et al. | |
| 5,103,532 A | | 4/1992 | Youngdale et al. | |
| 5,108,165 A | | 4/1992 | Rorke et al. | |
| 5,327,616 A | | 7/1994 | Lautenschläger, Jr. et al. | |
| 5,375,297 A | | 12/1994 | Lautenschläger, Jr. et al. | |
| 5,392,493 A | | 2/1995 | Youngdale | |
| 5,511,287 A | | 4/1996 | Lautenschläger, Jr. et al. | |
| 5,577,296 A | | 11/1996 | Grass | |
| RE36,213 E | | 6/1999 | Lautenschläger, Jr. et al. | |
| 6,095,738 A | * | 8/2000 | Selle | 411/183 |

FOREIGN PATENT DOCUMENTS

DE 4405349 A1 8/1996

OTHER PUBLICATIONS

Charles McMurray Catalog pp. 93 and 112–114.

* cited by examiner

*Primary Examiner*—Chuck Y. Mah
(74) *Attorney, Agent, or Firm*—Thomas R. Lampe

(57) ABSTRACT

A hinge is attached to a cabinet wall of a frameless cabinet by an elongated support plate. The cabinet wall has an opening, an elongated recess extending inwardly from the opening and an elongated slot extending along the elongated recess and in communication therewith. A fastener member is inserted into the opening and slid along the recess. A threaded bolt on the support plate is secured to the fastener member and tightened to secure the support plate at a desired location on the cabinet wall.

15 Claims, 4 Drawing Sheets

FRAMELESS CABINET HINGE CONNECTOR SYSTEM

FRAMELESS CABINET HINGE CONNECTOR SYSTEM

This application is a continuation-in-part of U.S. patent application Ser. No. 09/181,434, filed Oct. 28, 1998. Now U.S. Pat. No. 6,136,930

TECHNICAL FIELD

This invention relates to frameless cabinets and more particularly to a system for connecting a cabinet door to a cabinet wall of a frameless cabinet.

BACKGROUND OF THE INVENTION

Frameless cabinet constructions having cabinet walls with doors hingedly connected thereto are well known. German Offenlegungsschrift DE 4405349A1 discloses a structural wall having a recess extending from a front opening into the interior of the wall. The recess communicates with a slot formed in a wall side. A hinge member having flanges is connected to the wall structure by positioning the flanges in the recess and the hinge member per se in the slot communicating with the recess.

U.S. Pat. No. 5,067,200, issued Nov. 26, 1991, shows a hinge suitable for use with cabinets having inset doors. The hinge can be installed and adjusted on the door at the installation site. The hinge has hinge wings which are concealed when the door is in the closed position. The hinge includes a clamping plate parallel to a leg of a door wing engageable in a slot in the slotted edge of the door.

The following prior art also is known and believed representative of the current state of the prior art: U.S. Pat. No. 4,703,539, issued Nov. 3, 1987, U.S. Pat. No. 5,511,287, issued Apr. 30, 1996, U.S. Pat. No. 4,799,290, issued Jan. 24, 1989, U.S. Pat. No. 4,856,141, issued Aug. 15, 1989, U.S. Pat. No. 5,327,616, issued Jul. 12, 1994, U.S. Pat. No. 5,375,297, issued Dec. 27, 1994, U.S. Pat. No. 5,108,165, issued Apr. 28, 1992, U.S. Pat. No. RE. 36,213, issued Jun. 1,1999, U.S. Pat. No. RE. 30,717, issued Aug. 25, 1981, U.S. Pat. No. 5,052,077, issued Oct. 1, 1991, U.S. Pat. No. 4,615,072, issued Oct. 7, 1986, U.S. Pat. No. 4,517,706, issued May 21, 1985, U.S. Pat. No. 4,698,877, issued Oct. 13, 1987, U.S. Pat. No. 5,392,493, issued Feb. 28, 1995, U.S. Pat. No. 5,577,296, issued Nov. 26, 1996, U.S. Pat. No. 5,103,532, issued Apr. 14, 1992, U.S. Pat. No. 4,704,766, issued Nov. 10, 1987, and U.S. Pat. No. 4,976,006, issued Dec. 11, 1990. A frameless cabinet door hinge is closed in German Offenlegungsschrift DE 4405349A1. Other hinges of some degree of relevance are shown in pages 93 and 112–114 of the 1998 Charles McMurray Catalog.

The prior art indicated above does not teach or suggest the invention disclosed and claimed herein.

DISCLOSURE OF INVENTION

The present invention relates to a system for hingedly connecting a cabinet door to a cabinet wall of a frameless cabinet. The apparatus is characterized by its simplicity and relatively low cost. Furthermore, the installation of the hinge structure is quickly and easily accomplished. The resultant construction is quite strong.

Utilizing to the system of this invention, a hinge is fastened in place on a cabinet wall of a frameless cabinet quickly and efficiently. The cabinet wall includes spaced inner and outer wall sides and a wall front extending between the inner and outer wall sides. The cabinet wall defines an opening of predetermined size in the inner wall side spaced from the wall front. An elongated recess is spaced from the wall front communicating with the opening and extending rearwardly from the opening between the wall sides.

An elongated slot is formed in the inner wall side extending along the elongated recess and communicating therewith.

The opening has a vertical dimension greater than the vertical dimension of the elongated recess and the elongated recess has a vertical dimension greater than the vertical dimension of the elongated slot.

The structural combination further includes a hinge having a first hinge member for attachment to a cabinet door and a second hinge member pivotally connected to the first hinge member and including an elongated support plate having a distal end. The elongated support plate is of a length exceeding the combined lengths of the opening and the elongated slot.

Fastener means connects the elongated support plate to the cabinet wall, the fastener means comprising a threaded bolt extending from the elongated support plate into the elongated slot at a location spaced from the opening and a fastener member disposed in the elongated recess and releasably threadedly engaged with the bolt. A portion of the cabinet wall defining the elongated slot is clampingly engaged between the elongated support plate and the fastener member.

Other features, advantages, and objects of the present invention will become apparent with reference to the following description and accompanying drawings.

MODES FOR CARRYING OUT THE INVENTION

Figure 3:
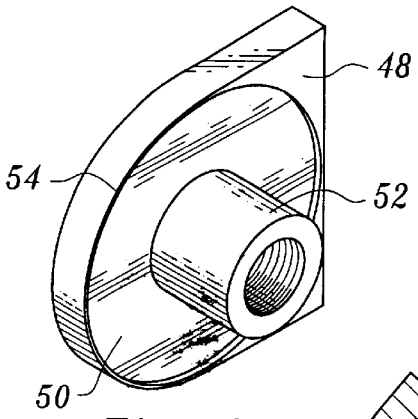
FIG. 3 is a perspective view of fastener means employed in association with the elongated support plate.

Referring now to FIGS. 1-5 and 7-12, a preferred embodiment of the invention is illustrated.

According to the invention, a hinge having pivotally moveable hinge members 10 and 12 is connected to an elongated support plate 14. More particularly, support plate 14 is directly connected to a stop plate or member 16 comprising part of the hinge member 12, the stop member 16 being disposed orthogonally relative to the elongated support plate.

The support plate 14 and the hinge are to be connected to a cabinet wall 18 of a frameless cabinet. Hinge member 12 supports and is secured to a cabinet door 20 for the cabinet.

The cabinet wall 18 includes spaced inner and outer wall sides 22, 24 respectively, and a wall front 26 extending between the inner and outer wall sides.

The cabinet wall defines a circular opening 30 of predetermined size in the inner wall side spaced from the front wall. An elongated recess 32 spaced from the front wall communicates with the opening 30 and extends rearwardly or inwardly from the opening between the wall sides. An elongated slot 34 is formed in the inner wall side extending along the elongated recess and communicating therewith.

The opening has a vertical dimension greater than the vertical dimension of the elongated recess and the elongated recess has a vertical dimension greater than the vertical dimension of the elongated slot.

The elongated support plate has a distal end 36 having an aperture 38 formed therein. The elongated support plate is of a length exceeding the combined lengths of the opening 30 and the elongated slot 34. The length of the elongated support plate also exceeds the distance between the innermost or rearmost end of the elongated slot and the stop member 16. The stop member or stop plate 16 has an abutment surface 40 which will engage wall front 26 of the cabinet wall 18 when the support plate and hinge are installed in position. When installed, the elongated support plate completely covers the opening and the elongated slot.

Fastener means is employed to connect the elongated support plate to the cabinet wall. The fastener means comprises a threaded bolt 46 projecting through aperture 38 and a fastener member threadedly engaged with the bolt. The fastener member includes a fastener plate 48 having a planar surface 50 and an internally threaded boss 52 extending outwardly from the planar surface. A generally circular projection in the form of a rib member 54 extends around the boss 52 and projects in the same direction as the boss.

Figure 1:
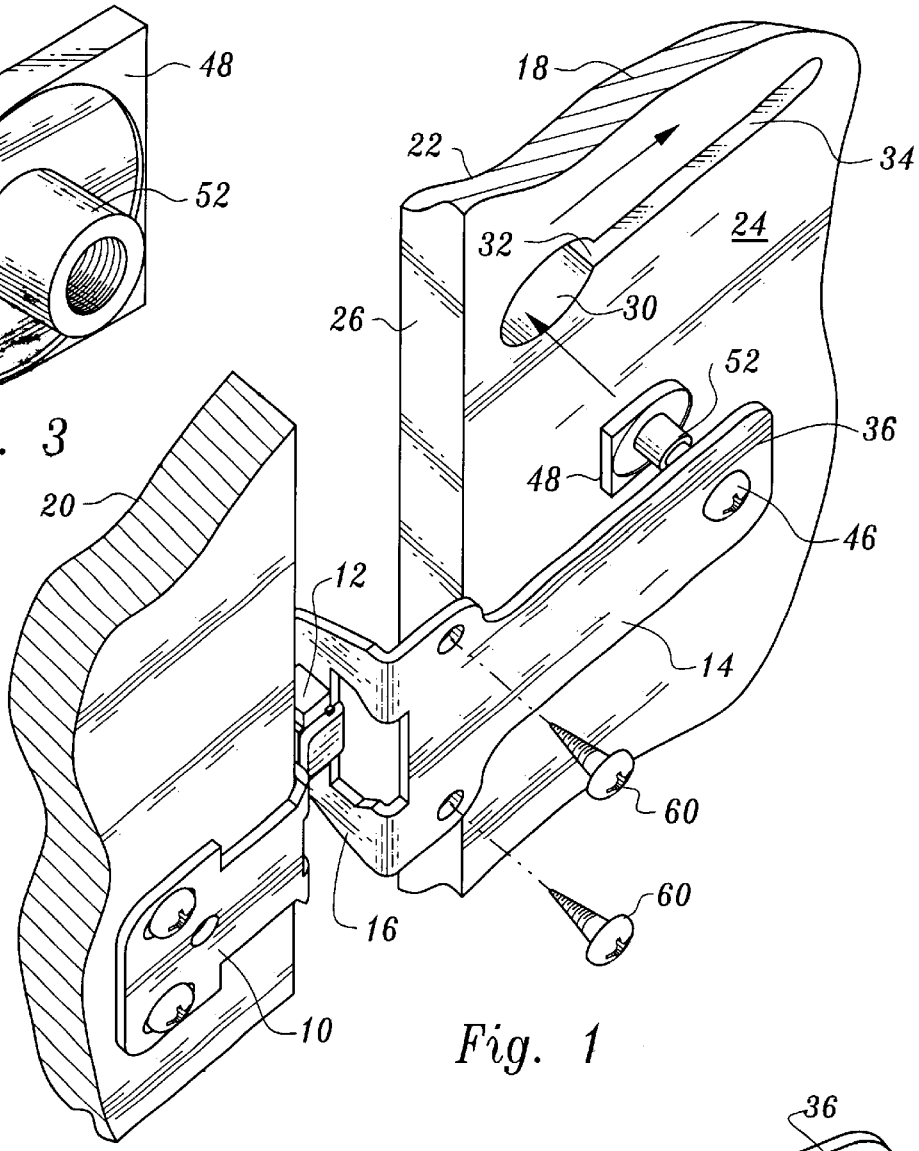
FIG. 1 is a perspective view illustrating an elongated support plate, hinge and fastener structure being attached to the wall of a frameless cabinet.
Figure 2:
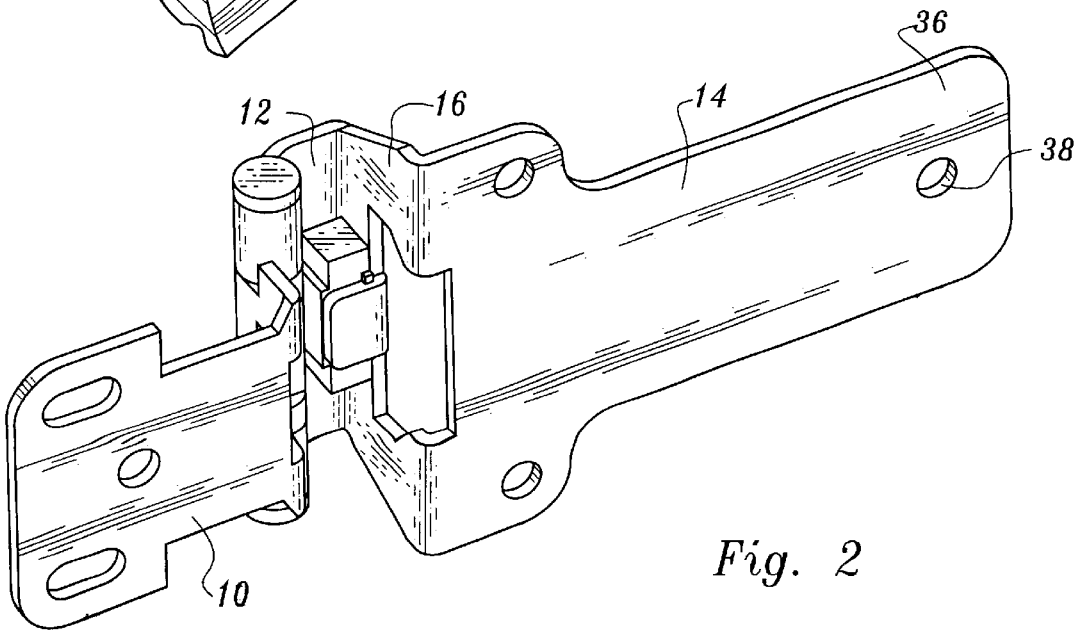
FIG. 2 is a perspective view of the hinge of FIG. 1 and two wood screws to be utilized when attaching the support plate to the cabinet wall.
Figure 4:
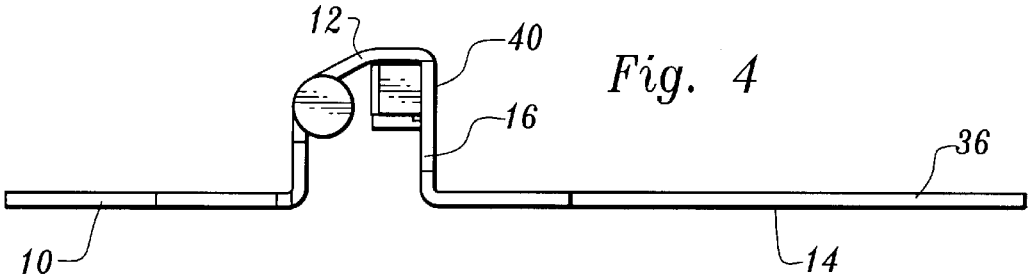
FIG. 4 is a top plan view of the hinge and support plate.
Figure 5:
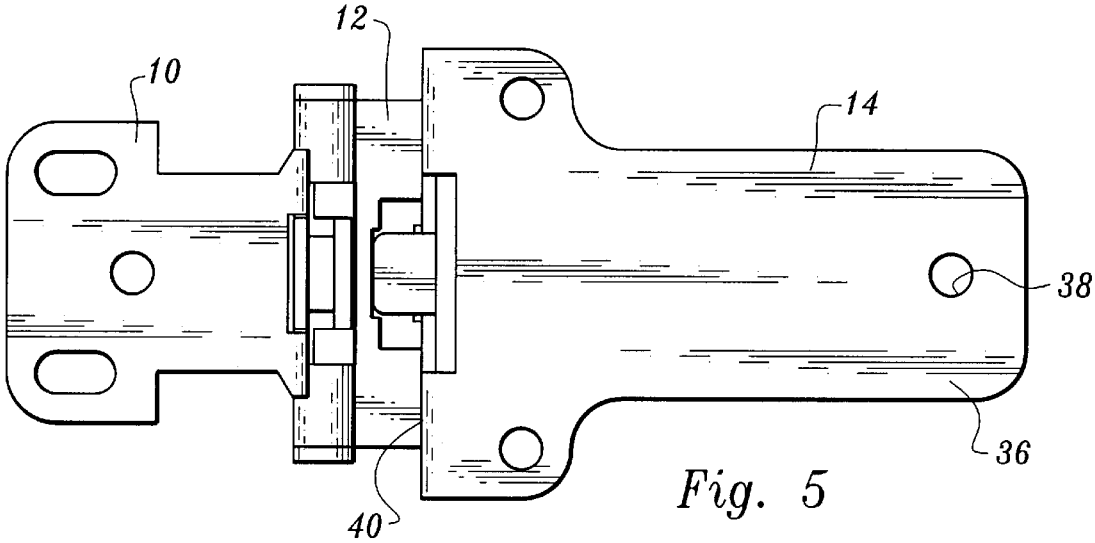
FIG. 5 is a front elevational view of the hinge and support plate.
Figure 7:
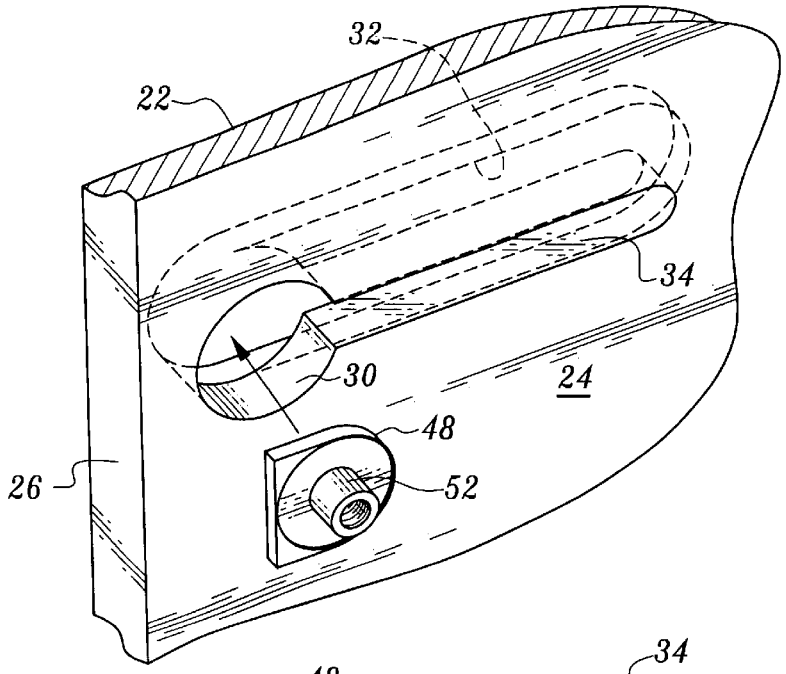
FIG. 7 is a perspective view illustrating a segment of the cabinet wall having a recess, slot and opening formed therein and illustrating a fastener member being inserted into the opening.

FIG. 1 shows the fastener member threadedly engaged with bolt 46 projecting inwardly from elongated support plate 14. Attachment of the support plate and associated structure is simplicity itself. The installer inserts the fastener member into opening 30, the opening being sized to allow ready insertion or removal of the fastener member. The insertion of the fastener member may take place with the fastener member connected to the support plate as shown in FIG. 1 or by itself as shown in FIG. 7. If the FIG. 7 approach is followed, the bolt 46 is screwed into the boss to secure the fastener member to the support plate after insertion of the fastener member into the opening.

Figure 8:
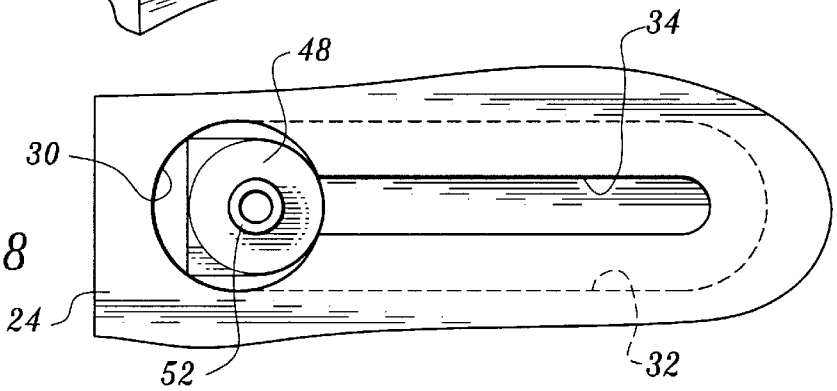
FIGS. 8–10 are elevational views of a portion of the cabinet wall illustrating the fastener plate at alternative locations with respect thereto.
Figure 9:
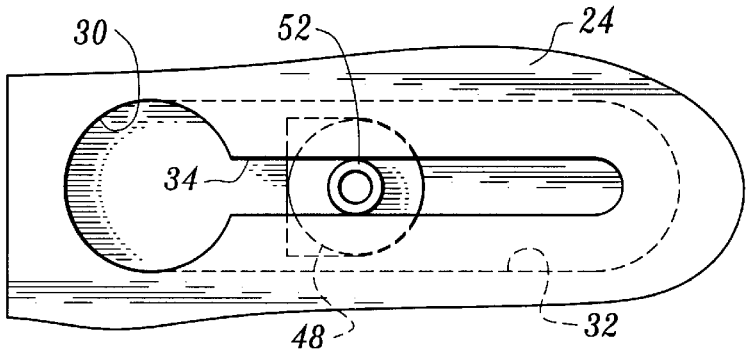
Figure 10:
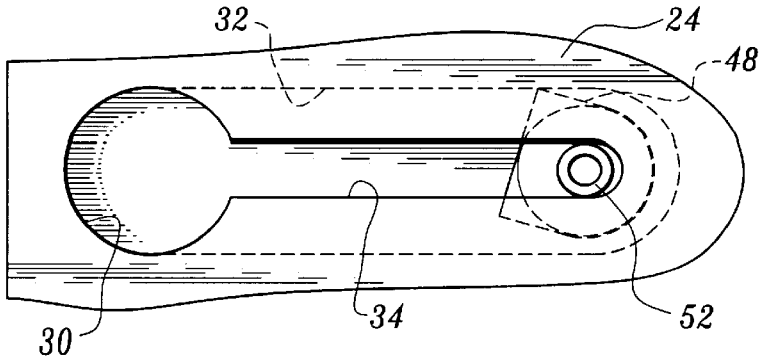
Figure 11:
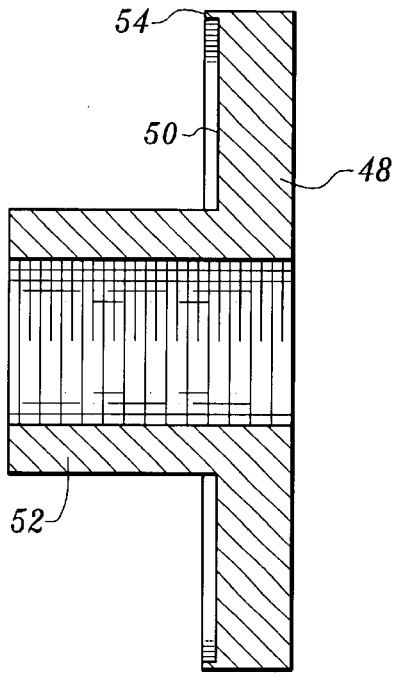
FIG. 11 is an enlarged, cross-sectional view of the fastener member.

After the fastener member is situated in the opening it is lined up with elongated recess 32, the rounded end of the fastener member oriented toward the far end of the recess, as shown. The fastener member is then moved to the desired location, as illustrated in FIGS. 8–10, for example, and the bolt 46 is then turned to cause clamping engagement of the portion of the cabinet wall defining the elongated slot 34 to secure the distal end of the elongated support plate in position.

The rearward movement of the fastener member and support plate relative to the cabinet wall prior to clamping of the cabinet wall therebetween is stopped when abutment surface 40 of stop member 16 engages the wall front 26. Because the vertical dimension of the recess 32 is less than the maximum outer peripheral dimension of the fastener plate 48, the plate will engage the cabinet wall to prevent turning of the fastener plate during the tightening operation (see FIG. 10).

Figure 12:
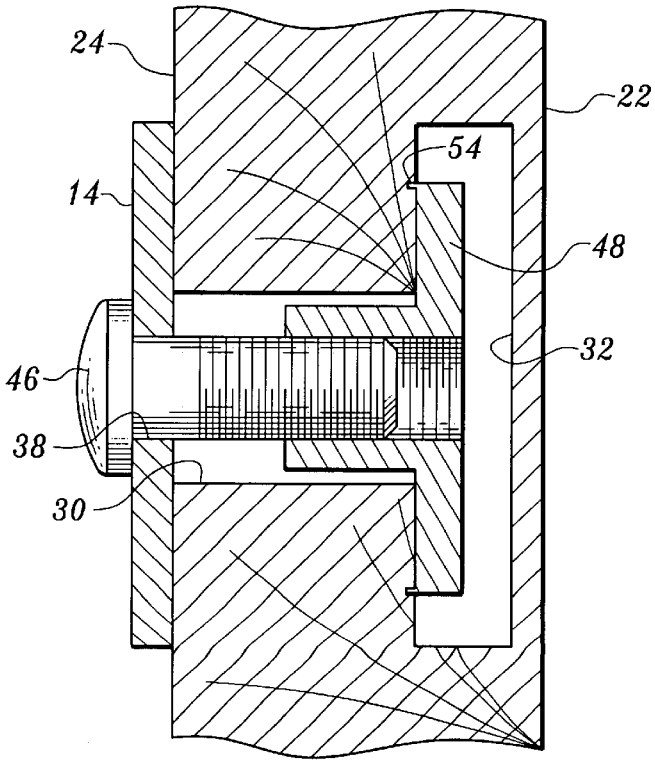
FIG. 12 is an enlarged, cross-sectional view illustrating the fastener member disposed in a recess formed in the cabinet wall and interconnected to the elongated support plate by a threaded interconnection between a bolt and a threaded boss of the fastener member.

When the fastener plate 48 is drawn toward the portion of the cabinet wall forming slot 34 during the clamping operation, the rib member 54 will "bite" into the cabinet wall as shown in FIG. 12, increasing structural stability and integrity at that location.

Abutment between the abutment surface 40 of stop member 16 and the wall front 26 serves to prevent the support plate from rotating about bolt 46. In addition, it is preferred that wood screws 60 (FIG. 2) be inserted through holes formed in the support plate and screwed into position on the cabinet wall. This further prevents support plate rotation.

Figure 6:
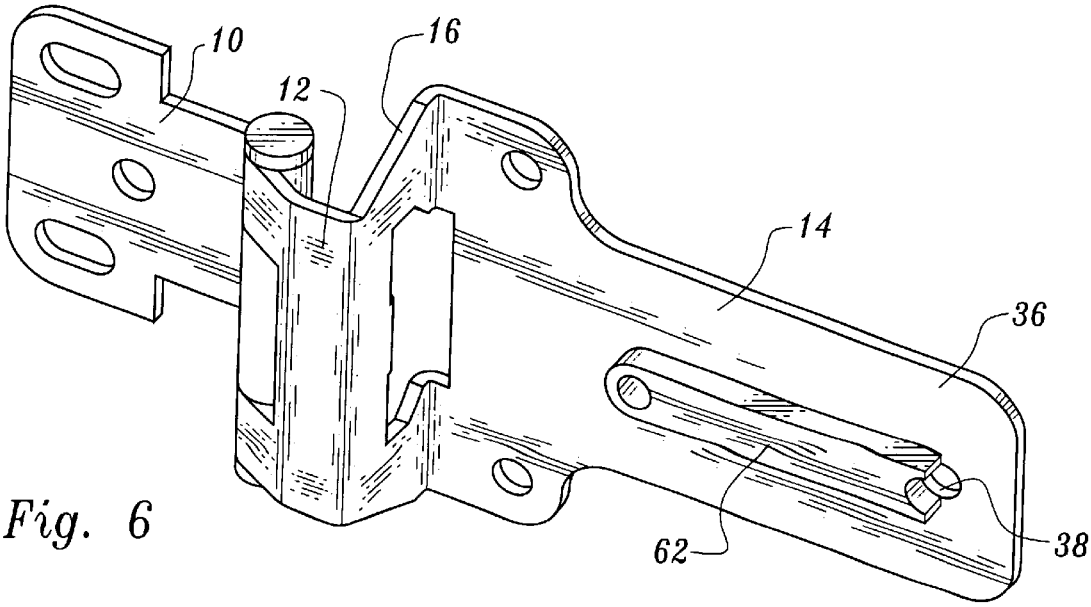
FIG. 6 is a rear perspective view of an alternative embodiment wherein a projection is affixed to the elongated support plate.

FIG. 6 illustrates an alternative embodiment of the invention wherein an elongated projection 62 projects from the inner face of the support plate closely adjacent to aperture 38. Projection 62 projects into elongated slot 34 when the support plate is fastened into position by bolt 46 and the fastener member to stabilize the support plate and prevent rotation thereof.

The invention claimed is:

1. In combination:

a cabinet wall of a frameless cabinet, said cabinet wall including spaced inner and outer wall sides and a wall front extending between said inner and outer wall sides, said cabinet wall defining an opening of predetermined size in said inner wall side spaced from said wall front, an elongated recess spaced from said wall front communicating with said opening extending rearwardly from said opening between said wall sides and an elongated slot formed in said inner wall side extending along said elongated recess and communicating therewith, said opening having a vertical dimension greater than the vertical dimension of said elongated recess and said elongated recess having a vertical dimension greater than the vertical dimension of said elongated slot;

a hinge including a first hinge member for attachment to a cabinet door and a second hinge member pivotally connected to said first hinge member and including an elongated support plate having a distal end, said elongated support plate being of a length exceeding the combined lengths of said opening and said elongated slot; and fastener means connecting said elongated support plate to said cabinet wall, said fastener means comprising a threaded bolt extending from the elongated support plate into the elongated slot at a location spaced from said opening and a fastener member disposed in said elongated recess and releasably threadedly engaged with said bolt, a portion of the cabinet wall defining said elongated slot clampingly engaged between said elongated support plate and said fastener member.

2. The combination according to claim 1 wherein said fastener member includes a fastener plate bearing against said portion of said cabinet wall defining said elongated slot and a threaded boss projecting from the fastener plate into said elongated slot, said boss being sized to allow slidable movement of said boss within said elongated slot when said elongated support plate and said fastener member are unclamped from said portion of said cabinet wall defining said elongated slot.

3. The combination according to claim 2 wherein said fastener plate is sized to permit selective positioning of said fastener plate into said opening or removal of said fastener plate from said opening.

4. The combination according to claim 2 wherein said fastener plate includes at least one projection oriented in the direction of said elongated support plate and pressed into said portion of said cabinet wall defining said elongated slot.

5. The combination according to claim 4 wherein said at least one projection comprises a rib member substantially surrounding said threaded boss and projecting in the same direction as said threaded boss.

6. The combination according to claim 5 wherein said rib member is generally circular and disposed closely adjacent to the outer periphery of said fastener plate.

7. The combination according to claim 2 wherein the vertical dimension of said recess is less than the maximum cross-sectional dimension of said fastener plate whereby complete rotation of said fastener plate in said recess is prevented.

8. The combination according to claim 1 additionally comprising stabilizer means for preventing rotation of said support plate relative to said cabinet wall when said portion of the cabinet wall defining said elongated slot is clampingly engaged between said elongated support plate and said fastener member.

9. The combination according to claim 8 wherein said stabilizer means comprises a stop member having an abutment surface, said stop member being on said second hinge member and connected to said elongated support plate, said abutment surface extending substantially orthogonally relative to said elongated support plate and overlying and in abutting relationship with a portion of said wall front.

10. The combination according to claim 9 wherein the length of said elongated support plate exceeds the distance between an innermost end of said elongated slot and said stop member and wherein said elongated support plate completely covers said opening and said elongated slot.

11. The combination according to claim 8 wherein said stabilizer means comprises a projection affixed to said elongated support plate adjacent to said threaded bolt and extending into said elongated slot and engaging the portion of the cabinet wall defining said elongated slot.

12. The combination according to claim 11 wherein said projection is elongated and has a vertical dimension generally corresponding to the vertical dimension of said elongated slot.

13. The combination according to claim 8 wherein said stabilizer means comprises at least one threaded fastener interconnecting said elongated support plate and said cabinet wall at a location spaced from said fastener member.

14. The combination according to claim 1 wherein said fastener means is located closely adjacent to the distal end of said elongated support plate.

15. A fastener for securing a hinge to a cabinet having a cabinet segment defining an opening, an elongated recess extending from the opening into the cabinet segment and an elongated slot extending along said elongated recess and in communication with said elongated recess, said fastener comprising;

a fastener member including a fastener plate having a planar surface and an internally threaded boss attached to said fastener plate and projecting from said planar surface, said fastener plate positionable in the recess of a cabinet segment through the opening and sized relative to the recess to prevent complete rotation of the fastener plate when in the recess, said boss projecting into the slot of the cabinet segment when the fastener plate is in said recess, and a projection in the form of a generally circular rib member extending about the threaded boss and projecting from the planar surface of the fastener plate in the same direction as said threaded boss; and a threaded bolt connected to structure operatively associated with a hinge and threadedly engaged with said boss to clamp a portion of the cabinet segment defining the slot between the fastener plate and the structure, said projection being pressed into said portion of the cabinet segment defining said slot when said portion of the cabinet segment defining said slot is clamped between said fastener plate and the structure.

* * * * *